US005145480A

United States Patent [19]

Wang

[11] Patent Number: 5,145,480

[45] Date of Patent: Sep. 8, 1992

[54] MAGNETIC RETARDING APPARATUS FOR AN EXERCISER

[76] Inventor: Kuo-Liang Wang, 58, Ma Yuan West St., Taichung, Taiwan

[21] Appl. No.: 741,551

[22] Filed: Aug. 7, 1991

[51] Int. Cl.[5] ..... A63B 21/00

[52] U.S. Cl. ..... 482/63; 482/5

[58] Field of Search ..... 272/70, 73, 129

[56] References Cited

U.S. PATENT DOCUMENTS 4,752,066 6/1988 Housayama ..... 272/73

4,775,145 10/1988 Tsuyama ..... 272/73

*Primary Examiner*—Stephen R. Crow

[57] ABSTRACT

A magnetic retarding device for an exerciser including a pair of links each having a lower end to the frame of the exercise, a bracket pivotally coupled pivotally coupled between the upper ends of the links which are arranged such that the bracket moves radially inward and outward of the wheel of the exerciser, a support fixed to the bracket and including one or more magnets disposed in two end walls, the magnets are caused to move radially inward and outward of the wheel when the bracket moves.

3 Claims, 5 Drawing Sheets

MAGNETIC RETARDING APPARATUS FOR AN EXERCISER

BACKGROUND OF THE INVENTION

1. Field of the Invention

The present invention relates to a retarding apparatus, and more particularly to a magnetic retarding apparatus for an exerciser, particularly a cycle exerciser.

2. Description of the Prior Art

One type of magnetic retarding apparatus was filed by the applicant, entitled "STRUCTURE OF STATIONARY BICYCLE MAGNETIC RETARDING FIELD", recently allowed. In this magnetic retarding apparatus, the bridging plate has a first end pivotally coupled to the frame of the exerciser, and has magnets disposed on the second end portion thereof so that the magnets are caused to rotate about the first end thereof. The magnets are not move radially about the wheel of the exerciser.

The present invention has arisen to provide a novel magnetic retarding apparatus.

SUMMARY OF THE INVENTION

The primary objective of the present invention is to provide a magnetic retarding apparatus for an exerciser in which the magnets move substantially radially relative to the wheel of the exerciser.

In accordance with one aspect of the present invention, there is provided a magnetic retarding device for an exerciser including a pair of links each having a lower end pivotally coupled to the frame of the exerciser and each including an upper end between which a bracket is pivotally coupled, the links are arranged such that the bracket moves radially inward and outward of the wheel of the exerciser, a support fixed to the bracket and including a pair of end walls each having one or more magnets disposed therein, the end walls being located on both sides of an outer peripheral edge of the wheel, and a driving device disposed on the frame of the exerciser and coupled to the bracket for driving the bracket to move radially inward and outward of the wheel, such that the magnets are caused to move radially inward and outward of the wheel when the bracket moves.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
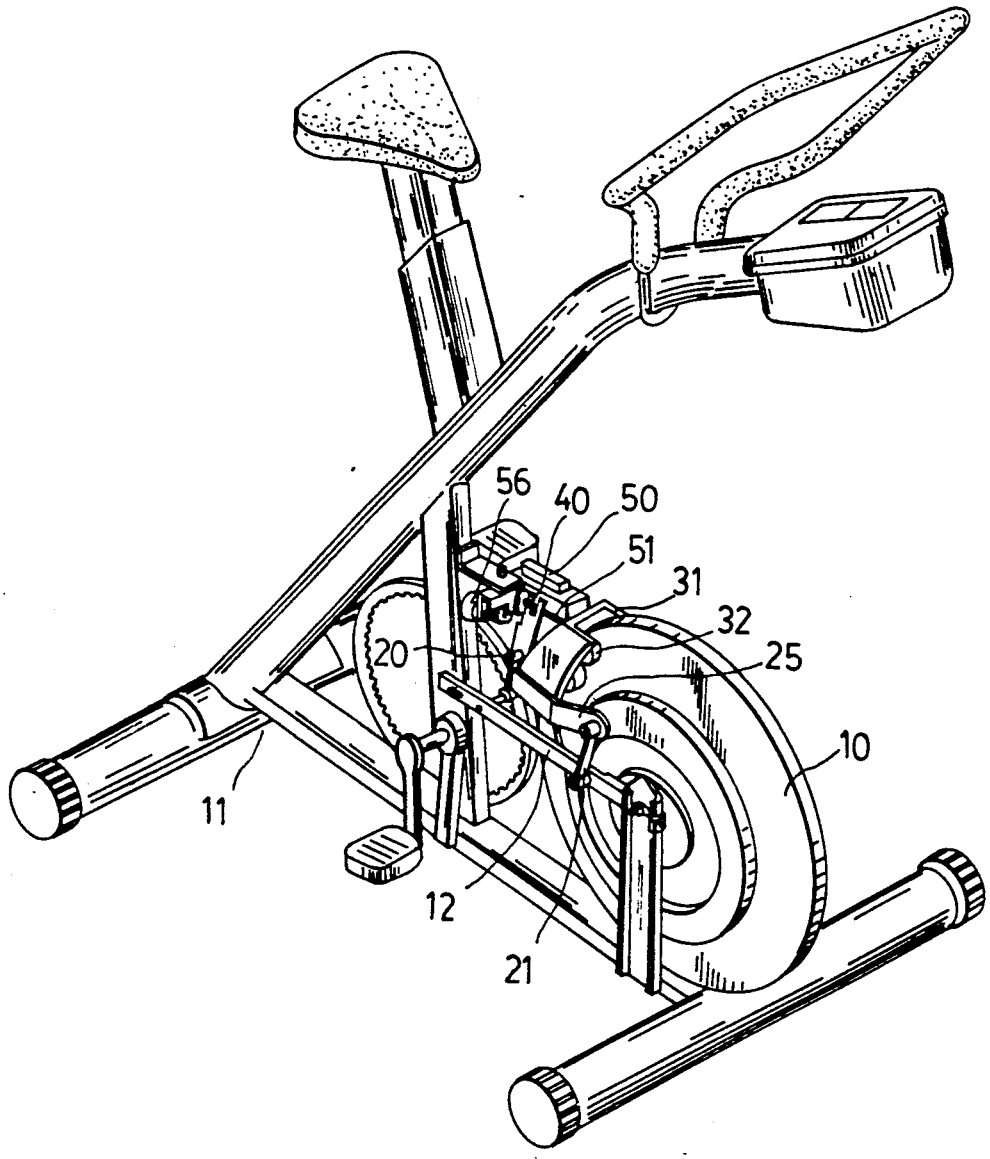
FIG. 1 is a perspective view of an exerciser in accordance with the present invention.
Figure 2:
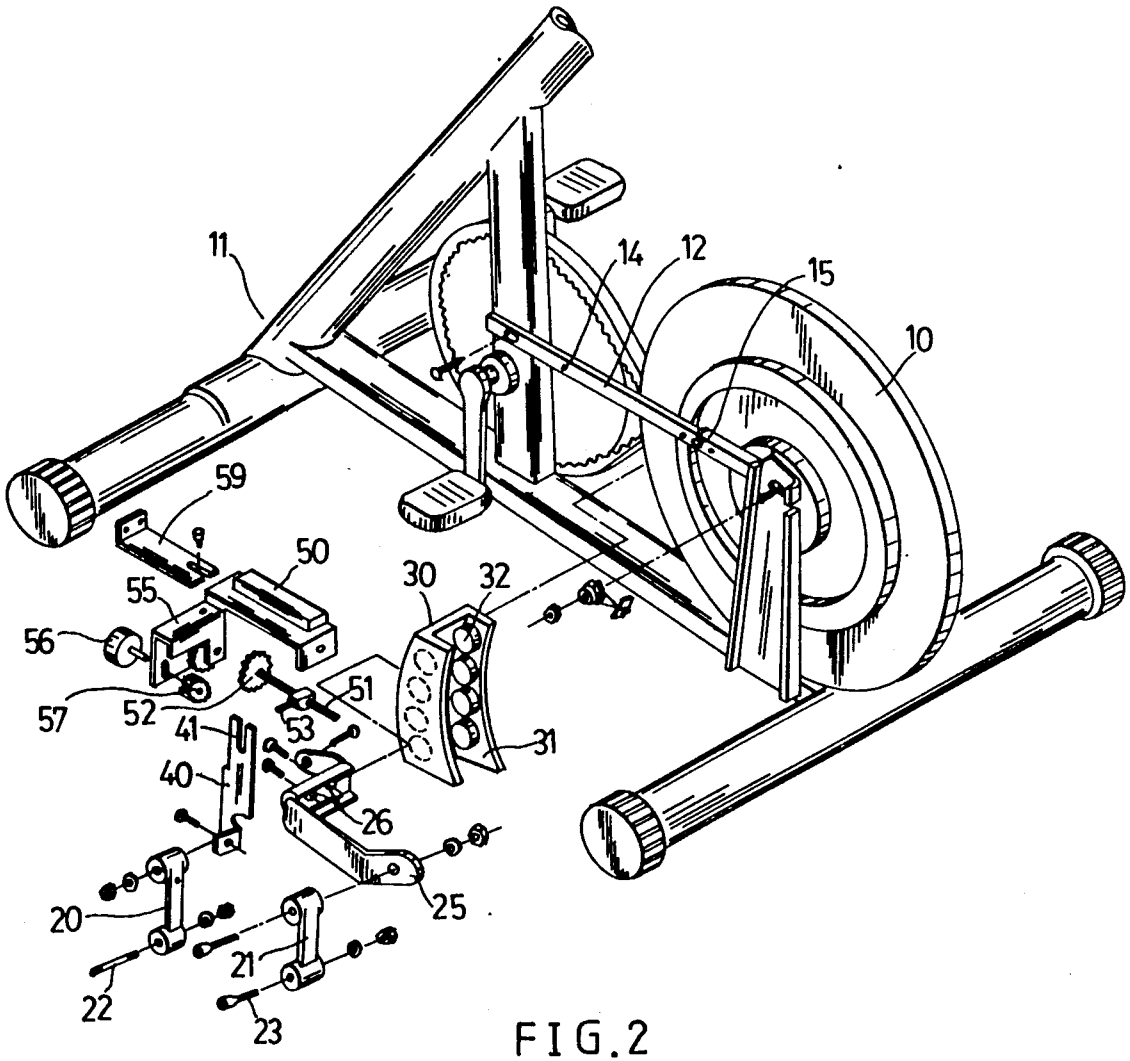
FIG. 2 is a partial exploded view of the exerciser.

Referring to the drawings and initially to FIGS. 1 and 2, a magnetic retarding apparatus in accordance with the present invention is generally disposed in an exerciser, particularly a cycle exerciser which comprises generally a wheel 10 rotatably supported on a frame 11 thereof. The frame 11 includes a bar 12 laterally disposed therein and having one end located at the axle of the wheel 10. The bar 12 has two holes 14, 15 formed therein.

Figure 4:
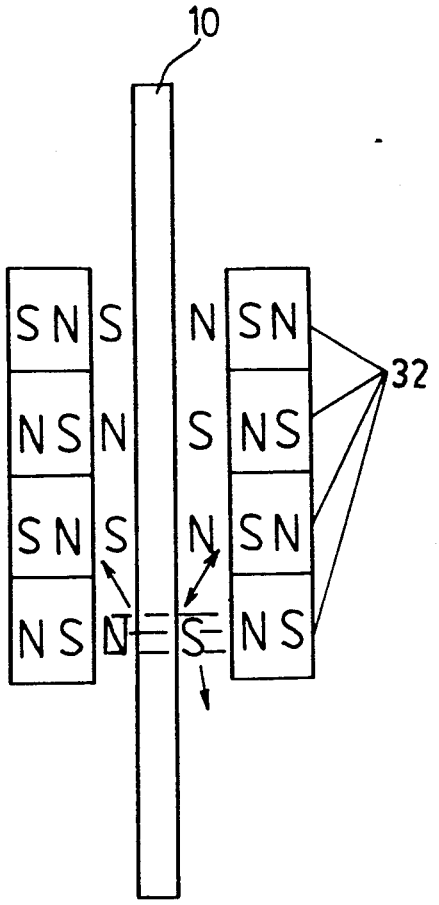
FIG. 4 is a schematic view illustrating the dispositions of the poles of the magnets thereof.

A pair of links 20, 21 each has a lower end pivotally coupled to the respective hole 14, 15 of the bar 12 by such as a pin 22 or a bolt 23 so that the links 20, 21 are rotatable about the lower end thereof. A bracket 25 has the end portions pivotally coupled to the upper ends of the links 20, 21 and has two orifices 26 formed therein. A support 30 is substantially U-shaped including a plurality of magnets 32 fixed in the two end wall portions 31 thereof and is fixed to the bracket 25 by such as bolts which extend through the orifices 26 of the bracket 25. The end wall portions 31 are located on both sides of the outer peripheral edge portion of the wheel 10. The preferable disposition of the poles of the magnets 32 is shown in FIG. 4. A follower 40 has a lower end solidly fixed to the upper end of the link 20 and has a groove 41 formed in the upper end thereof.

A housing 50 is coupled to the frame 11 of the exerciser by such as a plate 59 and has a bolt 51 rotatably supported therein. The bolt 51 has a pinion 52 fixed on one end thereof and has a guide 53 threadedly engaged thereon. The guide 53 has an extension engaged in the groove 41 of the follower 40 and is arranged such that the guide 53 moves longitudinally along the bolt 51 when the bolt 51 rotates. The follower 40 is caused to move by the movement of the guide 53 so that the bracket 25 can be caused to move substantially radially relative to the wheel 10, in which the links 20, 21 are caused to rotate about the lower ends thereof.

The housing 50 also includes a board 55 laterally extended therefrom on which a motor 56 is disposed. A gear 57 is coupled to the spindle of the motor 56 and is engaged with the pinion 52 of the bolt 51 such that the bolt 51 can be caused to rotate by the motor 56. A reduction gearing (not shown) or the like can be coupled between the gear 57 and the pinion 52 in order to determine the rotational speed of the bolt 51. A variable resistor 58 is disposed on the housing 50. The resistance of the variable resistor 58 is varied according to the relative position of the guide 53 along the bolt 51 and is propagated to the sensor 61 (FIG. 5) so that the relative position of the guide 53 along the bolt 51 can be detected.

Figure 3:
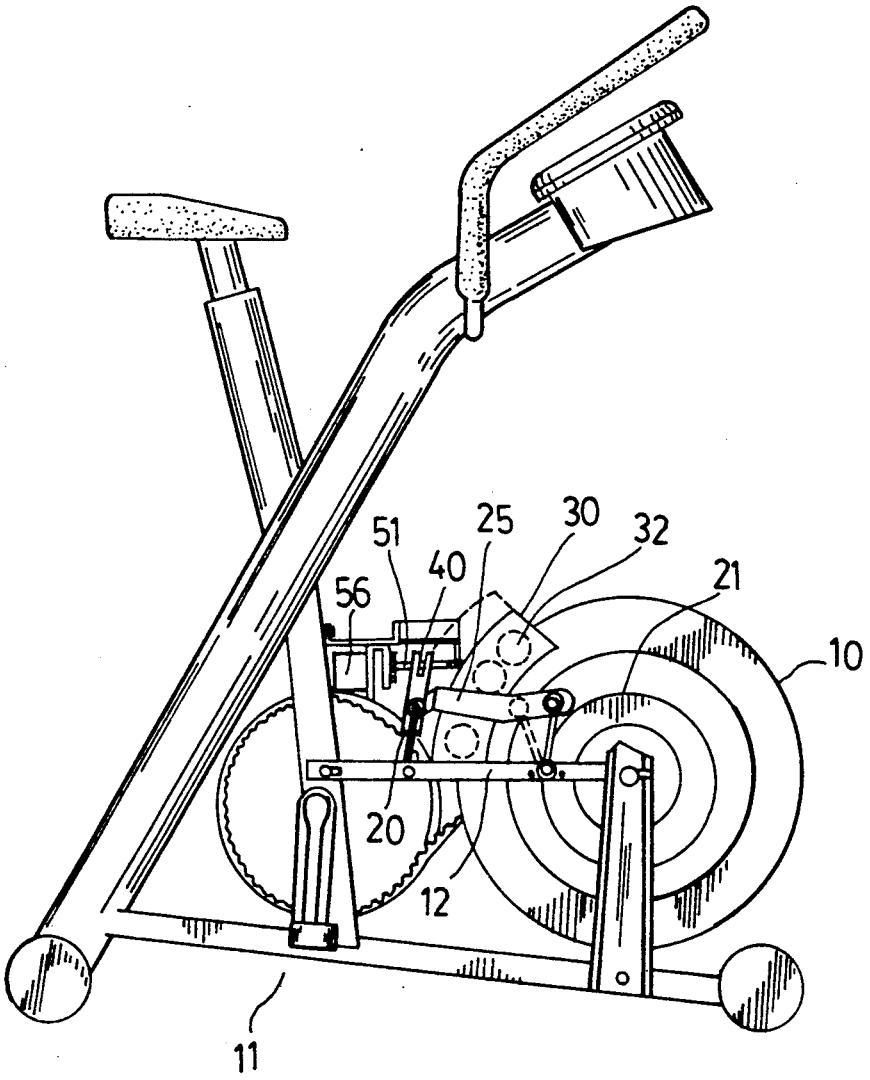
FIG. 3 is a plane view of the exerciser.

In operation, as shown in FIG. 3, when the bolt 51 is caused to rotate by the motor 56, the guide 53 will be caused to move longitudinally along the bolt 51, and in turn, the links 20, 21 will be caused to rotate about the lower ends thereof by the follower 40 such that the support 30 move substantially radially relative to the wheel 10 and such that the magnets 32 are movable simultaneously radially inward and outward of the wheel 10, as shown in dotted lines and solid lines in FIG. 3. The resistance applied to the wheel 10 will be increased when the magnets 32 move radially inward of the wheel 10.

Figure 5:
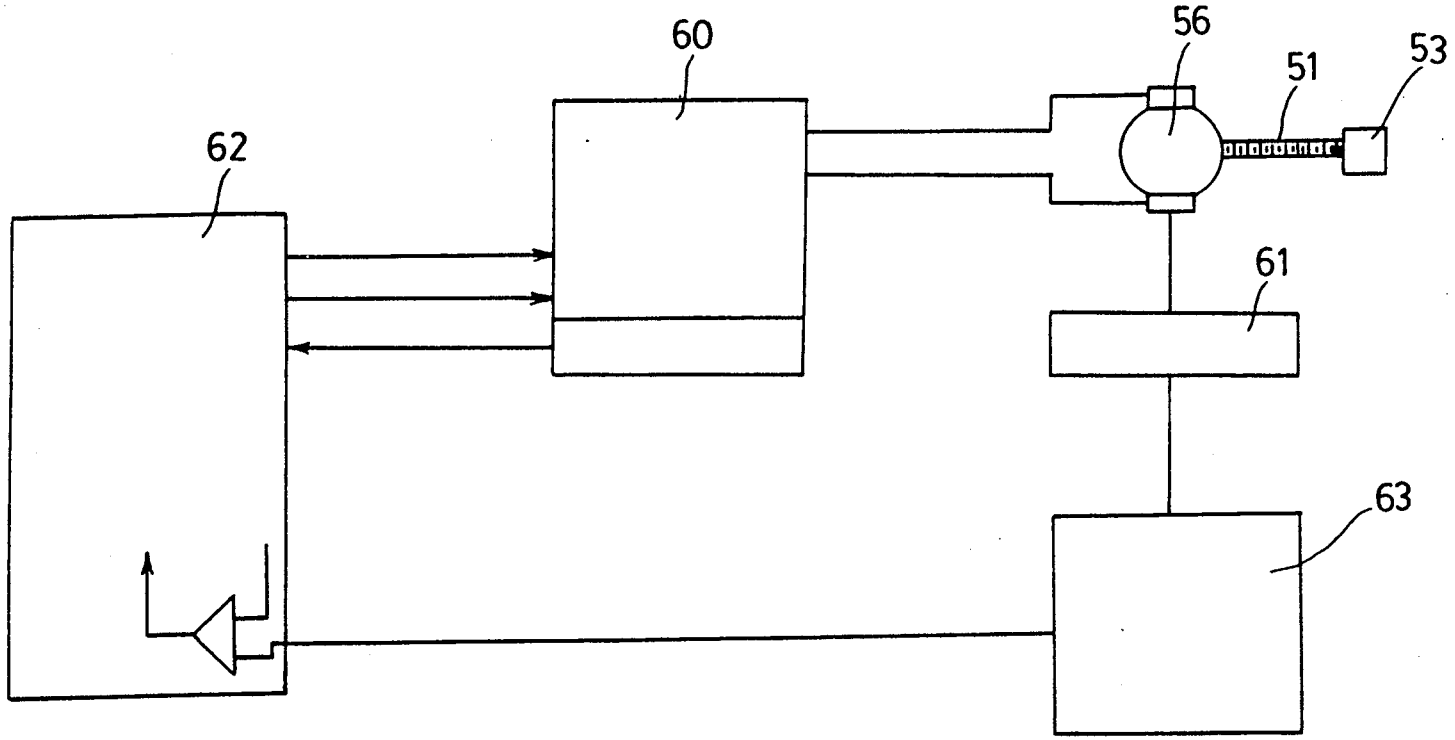
FIG. 5 is a block diagram illustrating a control circuit.

Referring next to FIG. 5, the guide 53 is threadedly engaged on the bolt 51 which is driven by the motor 56. A motor control means 60 is coupled between the motor 56 and a micro computer 62 or the like so that the operations of the motor 56 can be controlled by the micro computer 62 via the motor control means 60. The sensor 61 and a positioning means 63 are coupled in series between the motor 56 and the micro computer 62 and are disposed in parallel to the motor control means 60. The relative position of the guide 53 along the bolt 51 can be controlled by the micro computer 62 via the sensor 61 and the positioning means 63.

Figure 6:
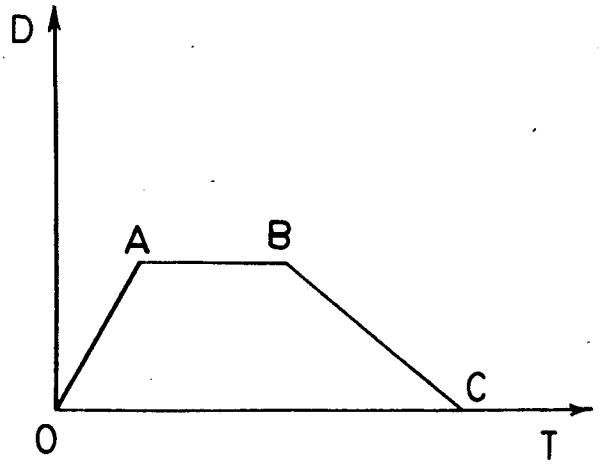
FIG. 6 is a schematic view illustrating the relations between the positions of the magnets and time.

Referring next to FIG. 6, the resistance applied to the wheel 10 can be predetermined via the computer 62. The character "D" in vertical axis represents the radially inward distance of the magnets 32 beyond the outer peripheral edge of the wheel 10. The resistance applied to the wheel increases when the value of "D" is increased. "T" in lateral axis represents time. In segment OA, the magnets 32 gradually move radially inward of the wheel 10 so that the resistance applied to the wheel 10 increases gradually such that the user may feel like climbing up a hill. In segment AB, the magnets 32 are located, for example, at a most radially inward position of the wheel such that the resistance applied to the wheel is the largest. In segment BC, the magnets 32 move radially outward of the wheel 10 such that the user may feel like cycling down a hill.

Accordingly, the magnets of the magnetic retarding apparatus in accordance with the present invention can be controlled to move radially inward and outward of the wheel.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetic retarding apparatus for an exerciser, said exerciser comprising a wheel rotatably supported on a frame thereof, said frame including a bar laterally disposed therein; said magnetic retarding apparatus comprising a pair of links each having a lower end pivotally coupled to said bar of said frame and each including an upper end; a bracket pivotally coupled between said upper ends of said links which are arranged such that said bracket moves substantially radially inward and outward of said wheel; a support fixed to said bracket and including a pair of end wall portions each having at least one magnet disposed therein, said end wall portions being located on both sides of an outer peripheral edge of said wheel; and a driving means disposed on said frame of said exerciser and coupled to said bracket for driving said bracket to move substantially radially inward and outward of said wheel, said driving means including a housing fixed on said frame of said exerciser; a bolt rotatably supported in said housing; a pinion fixed on one end of said bolt; a motor disposed in said housing and having a gear fixed to a spindle thereof, said gear being engaged with said pinion of said bolt; a guide threadedly engaged on said bolt and including an extension; and a follower coupled to said bracket and having a groove formed therein for receiving said extension of said guide; said guide will be caused to move longitudinally along said bolt when said bolt is driven by said motor so that said bracket can be caused to move; such that said magnets are caused to move substantially radially inward and outward of said wheel when said bracket moves.

2. A magnetic retarding apparatus according to claim 1, wherein said housing includes a board laterally extended therefrom, said motor is disposed on said board.

3. A magnetic retarding apparatus according to claim 1, wherein said groove is formed in an upper end of said guide.

* * * * *